United States Patent [19]

Russello et al.

[11] Patent Number: 4,760,511

[45] Date of Patent: Jul. 26, 1988

[54] LIGHT FIXTURE

[75] Inventors: Thomas Russello, Howell; Richard Sangiamo, Linden, both of N.J.

[73] Assignee: Keene Corporation, Union, N.J.

[21] Appl. No.: 937,386

[22] Filed: Dec. 3, 1986

[51] Int. Cl.[4] ..... F21M 3/18

[52] U.S. Cl. ..... 362/427; 362/419; 362/404; 362/275

[58] Field of Search ..... 362/427, 407, 287, 275, 362/419, 404

[56] References Cited

U.S. PATENT DOCUMENTS

| | | | |
|---|---|---|---|
| 3,388,246 | 6/1968 | Bailey | 362/419 |
| 3,604,916 | 9/1971 | Adra | 362/427 |
| 4,090,210 | 5/1978 | Wehling et al. | 362/419 |
| 4,143,413 | 3/1979 | Kelly | 362/418 |
| 4,473,873 | 9/1984 | Quiogue | 362/427 |
| 4,609,979 | 9/1986 | Kristofek | 362/427 |
| 4,626,975 | 12/1986 | Miletich | 362/427 |

FOREIGN PATENT DOCUMENTS

| | | | |
|---|---|---|---|
| 370764 | 2/1907 | France | 362/427 |

*Primary Examiner*—James C. Yeung

*Attorney, Agent, or Firm*—Kane, Dalsimer, Sullivan, Kurucz, Levy, Eisle and Richard

[57] ABSTRACT

A light fixture is provided having a mounting base and a housing. The base and housing are connected to each other by an arm that extends from a corner of the top of one to a corner of a side of the other. This arrangement permits the base to rotate with respect to the housing between a position wherein the housing is generally parallel to the base to a position wherein the base is generally perpendicular to the housing.

7 Claims, 5 Drawing Sheets

LIGHT FIXTURE

BACKGROUND OF THE INVENTION

The present invention relates to light fixtures and in particular to a light fixture adapted to be ceiling or wall hung with the light source held in its proper orientation.

Light fixtures, and particularly high intensity light fixtures are usually designed to be either ceiling hung or wall mounted. When a fixture is designed for ceiling mounting the associated reflector is designed to throw off the light in a generally uniform pattern as represented by "C" in FIG. 9. Conversely, when a fixture is designed for wall mounting the light distribution pattern is such that the majority of the light flux is thrown out away from the wall with a lessor amount washing down the wall as represented by "W" in FIG. 9.

If a fixture designed for ceiling mounting were to be mounted on a wall, much of the light energy would be wasted washing down the wall. Similarly, if a fixture designed for wall mounting were to be mounted on a ceiling much of the light energy would be lost washing across the ceiling.

While various brackets have heretofore been developed which enable a fixture designed for one type of mounting to be used with the other, the fundamental problem has not been addressed which stems from the fact that a ceiling fixture is designed to direct light downwardly and a wall fixture is designed to throw light out generally horizontally.

Heretofore attempts have been made to provide high intensity fixtures which could be both wall and ceiling mounted but, in the main, such attempts have concentrated on compromising the light distribution pattern of the mixture so that it is optimized for neither wall nor ceiling mounting.

SUMMARY OF THE INVENTION

In view of the above, it is the principal object of the present invention to provide an improved light fixture mounting arrangement which permits the fixture to be properly oriented regardless of whether the fixture is to be wall mounted or ceiling mounted.

A further object is to provide such a fixture which is aesthetically pleasing regardless of the orientation of mounting.

A still further object is to provide such a fixture wherein the heat generating components receive proper ventilation and air circulation regardless of the orientation in which it is hung.

Yet another object is to provide a fixture which is cost competitive with conventional fixtures and which may be constructed utilizing conventional components.

The above and other objects and advantages are attained in accordance with the present invention by providing a high intensity light fixture comprising a housing member and a base member. The housing contains therein the ballast and wiring components for the fixture and contains at one end a lamp socket assembly and the fixture reflector. The base member is connected to the housing at the opposite end of the housing. To this end an elongated arm extends from one corner of the base member to a corner of the housing member and holds the base in spaced relationship to the housing. The arm is rotatably mounted to a side of one of the members and rotatably mounted to a flat surface of the other of the members so that the base and housing may be rotated with respect to each other between a first position wherein the base is parallel to the housing to a second position wherein the base is generally perpendicular to the housing.

DETAILED DESCRIPTION OF THE PREFERRED EMBODIMENT

Figure 1:
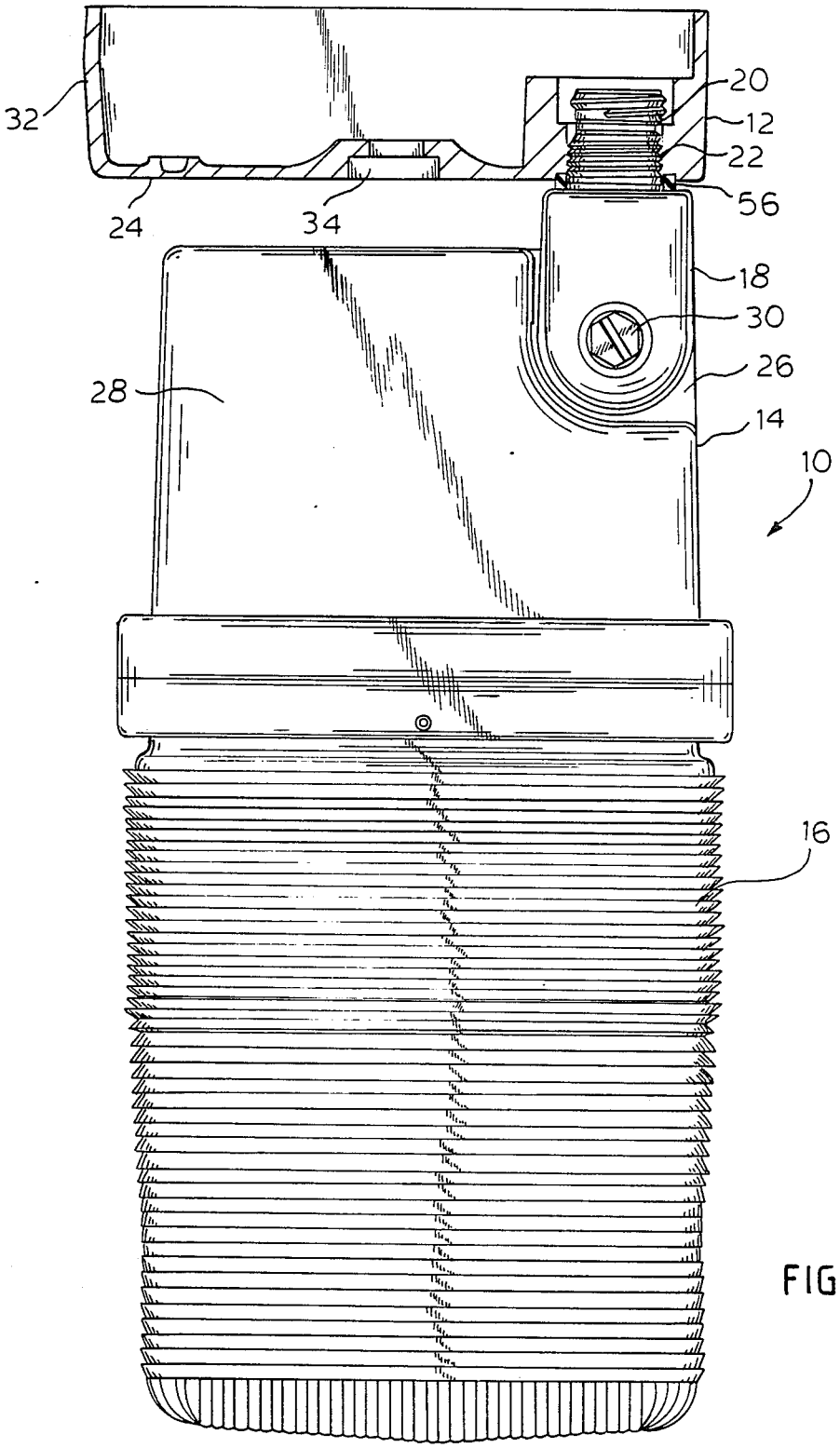
FIG. 1 is a side elevational view, partly in section, of the light fixture of the present invention.

Reference is now made to the drawings and to FIG. 1 in particular wherein a light fixture 10 in accordance with the present invention is shown comprising a base member 12, a housing member 14, and a reflector 16. An arm 18 extends between the base member 12 and housing member 14 and holds to the two in a spaced apart relationship. To this end, the arm 18 has a threaded portion 20 which engages a threaded opening 22 in the top plate 24 of the base member. The other end of arm 18 is secured within a recess or indentation 26 defined in a sidewall 28 of the housing at a corner thereof and is held in position by a screw 30.

The base member comprises plate 24 from which falls 32 extends to define a cavity through which the wiring for the fixture may be drawn. A mounting plate (not shown) can be attached to the base member by means of a fastener passing through opening 34.

Figure 2:
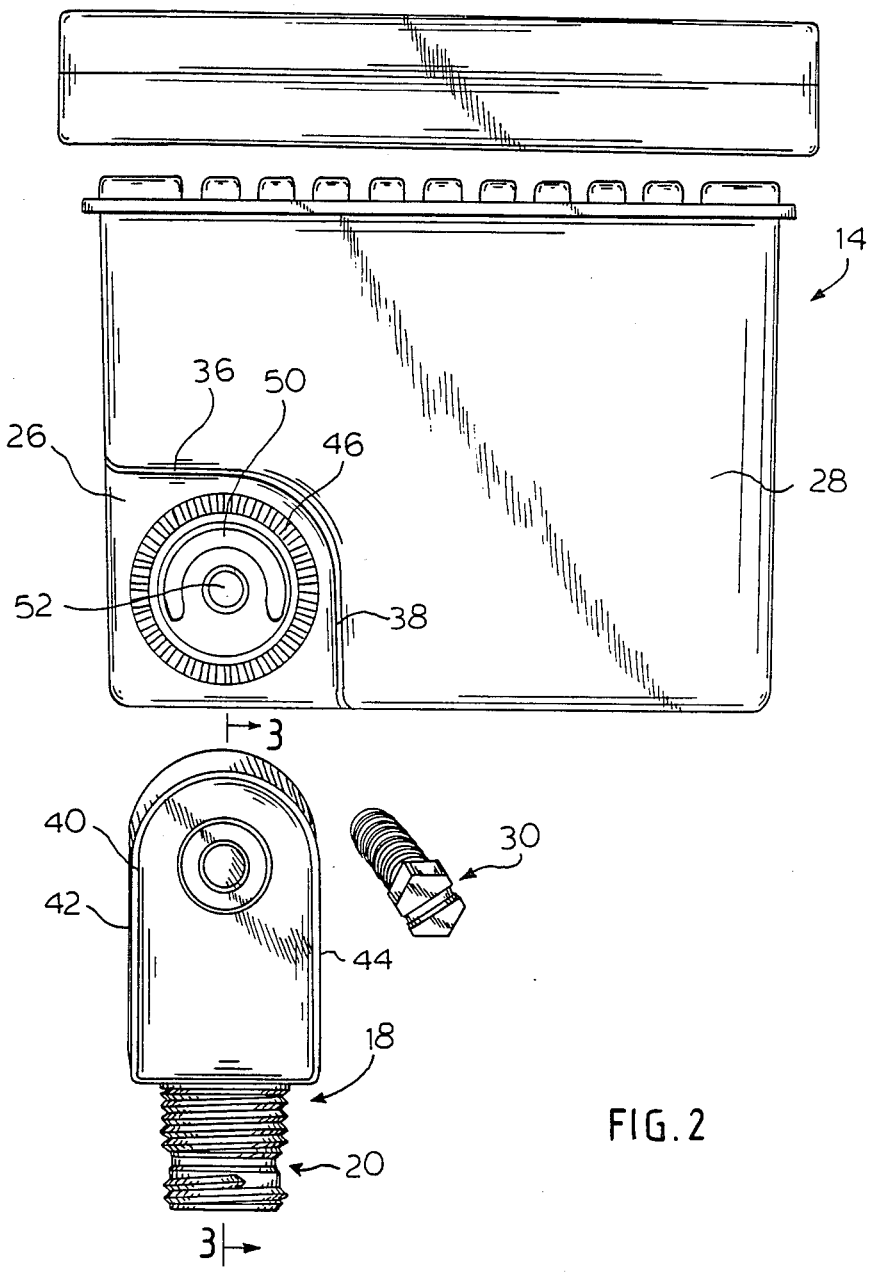
FIG. 2 is an exploded side elevational view of the connection between the fixture housing member and the connecting arm.
Figure 3:
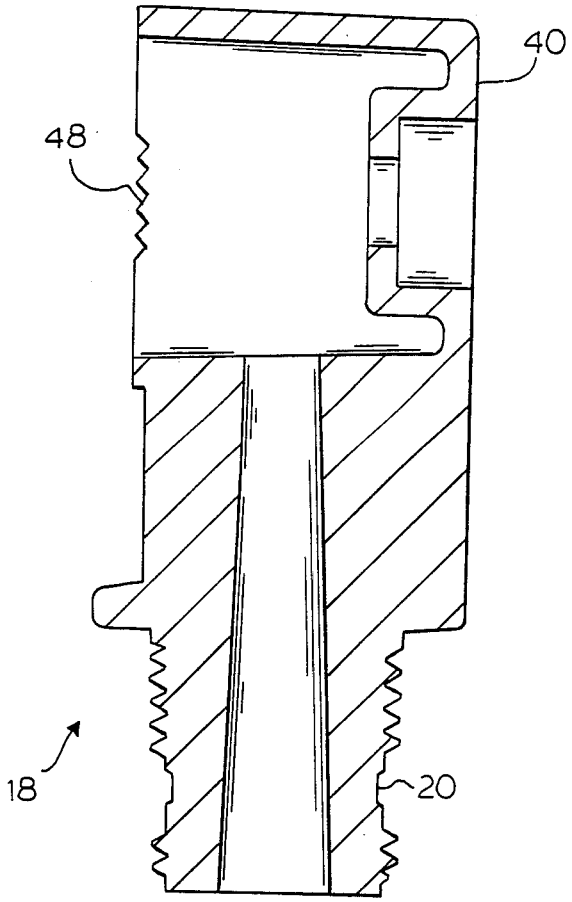
FIG. 3 is a side elevational sectional view of the joining arm taken along reference line 3—3 of FIG. 2.
Figure 4:
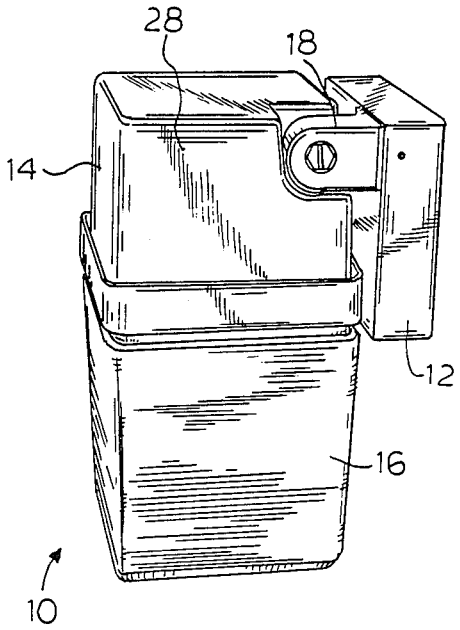
FIGS. 4–8 are perspective views of the fixture of the present invention depicting the displacement of the base member with respect to the housing member as it is rotated from a wall mounting orientation (FIG. 4) to a wall mounting arrangement; and, FIG. 9 is a diagrammatic view of the light distribution patterns obtained with different mountings.
Figure 5:
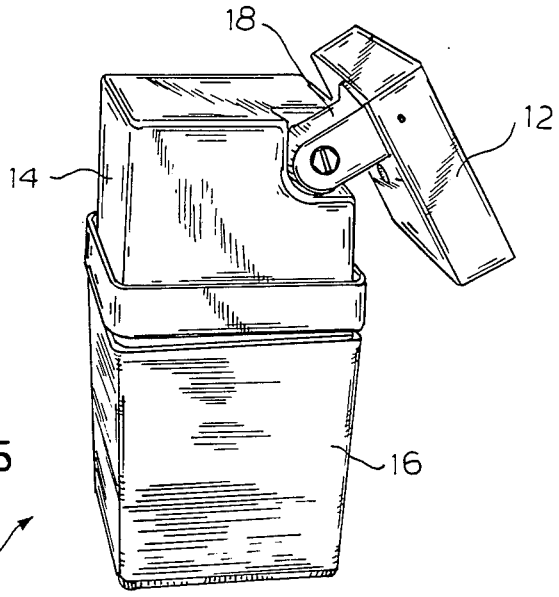
Figure 6:
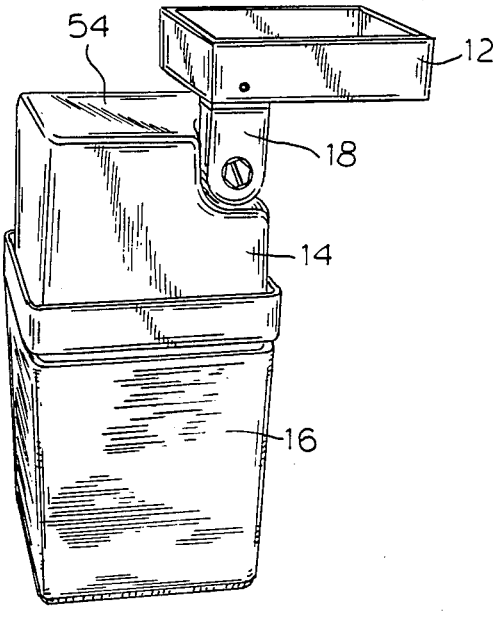
Figure 7:
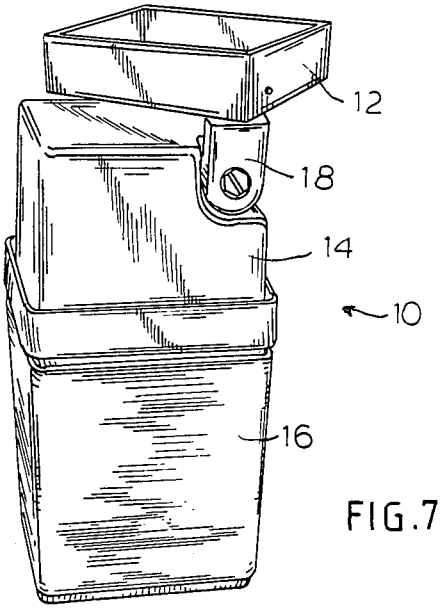
Figure 8:
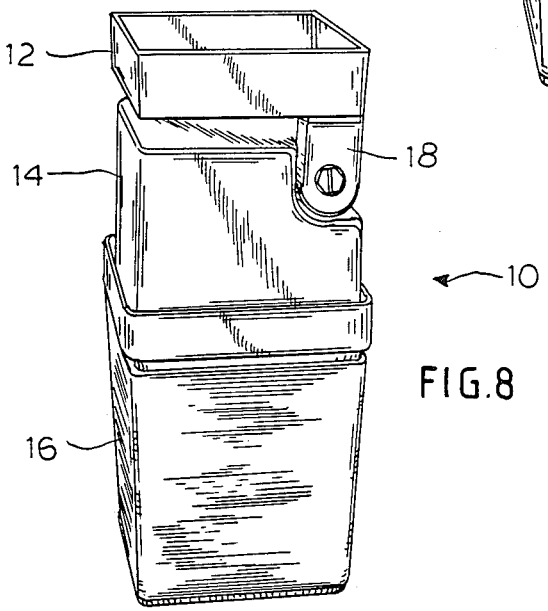
Figure 9:
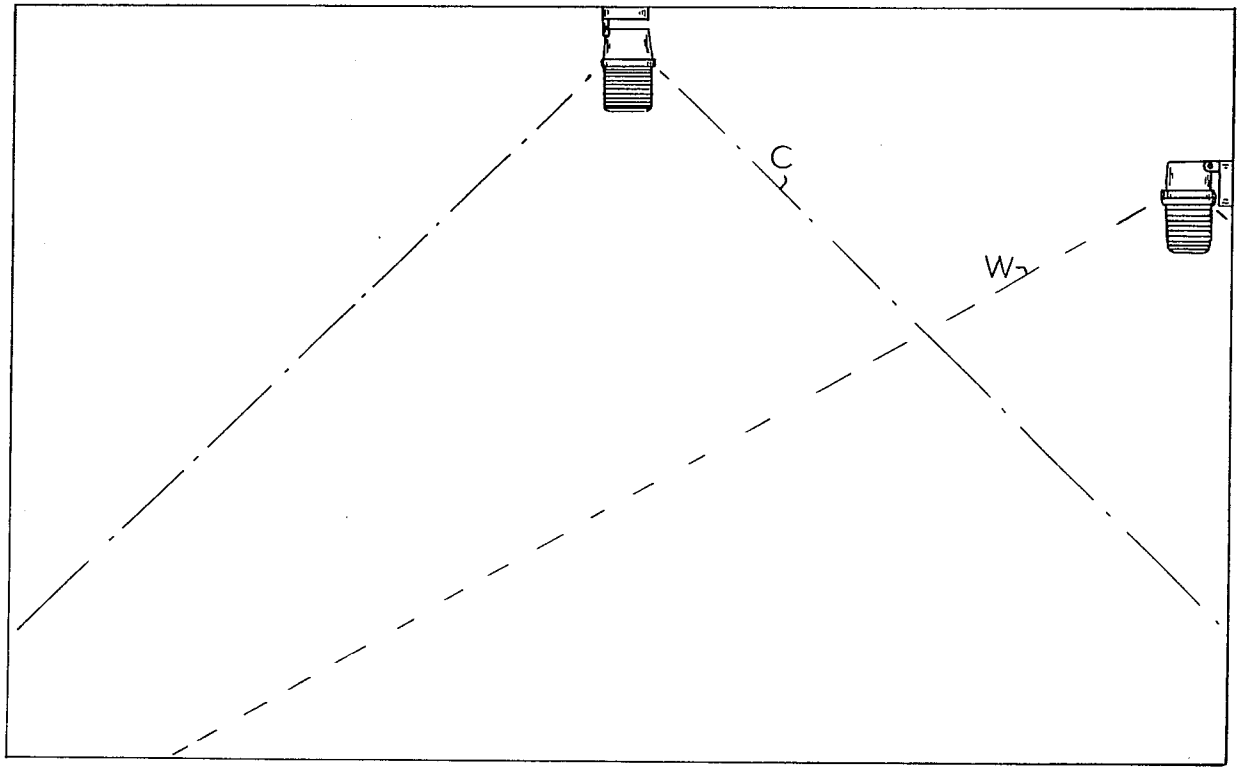

Referring now to FIG. 2, it can be seen that the indentation 26 formed in sidewall 28 of housing 14 is defined by a pair of generally perpendicular walls 36 and 38. The top 40 of arm 18 is provided with generally parallel sidewalls 42 and 44 which, when abutted against the sidewalls 36 and 38 will hold the arm (and hence the attached base member) either aligned with or perpendicular to the longitudinal axis of the housing member. A serrated circle 46 is provided in the indentation 26 and complementary serrations 48 are provided on the arm 18 as shown in FIG. 3. A slotted opening 50 is provided coaxial with the serrated circle 46 partly surrounding a threaded opening 52 for bolt 30.

Referring to FIG. 3, it can be seen that the arm 18 is hollow thereby permitting wires drawn into the base member 12 to be fed into the housing member 14 through the opening 50. The ballast and other components for the housing, including a lamp socket may be mounted in the housing.

Referring now to FIGS. 4–8, it can be seen that by properly rotating the base member 12 and the arm 18 with respect to the housing member the base member can be moved between a position (shown in FIG. 4) wherein the base member is parallel to the sidewalls of the housing to a position (shown in FIG. 8) wherein the base member is parallel to the flat top surface (in the depicted orientation) 54 of the housing 14. It should be noted that the orientation of the reflector 16 has not changed between FIGS. 4 and 8 and hence the reflector assembly remains in the proper orientation for maximum light distribution. In addition, the fixture could also be hung in any intermediate position. It should further be noted that in each position a substantial gap is maintained between the base and the housing to insure a good air flow about the housing.

As the arm 18 rotates about bolt 30 the serrations 46 and 48 cooperated in securing the housing in the desired orientation when the bolt is tightened. In order to seal the interior of the base 12 as the arm 18 is rotated about threads 22 (which would have the tendency to tighten or loosen the connection, a gap gasket 56 is provided at the top of the threaded portion 20. The gasket 56 serves to maintain the seal as the arm position is changed. Thus, in accordance with the above, the aforementioned objects are effectively attained.

Having thus described the invention, what is claimed is:

1. A light fixture comprising:

a base member having a flat surface with sides extending from the periphery thereof;

a fixture housing member having a flat surface with sides extending from the periphery thereof; and, an elongated arm joining said members and extending from a corner of said base member to a corner of said housing member, said arm being rotatably mounted to the flat surface of one of said members along an axis perpendicular to said surface at one of said corners and to a side of the other of said members along an axis perpendicular to said side at the other of said corners, whereby said members may be rotated with respect to each other between a first position wherein the members are generally aligned and parallel to a second position wherein the members are generally aligned and perpendicular.

2. The fixture in accordance with claim 1 wherein said arm holds said members in spaced apart relationship.

3. The fixture in accordance with claim 2 wherein the side of the other of said members is indented at the other of said corners to define two walls generally perpendicular to each other whereby said arm can rotate between a first position parallel to one of said walls to a second position parallel to the other of said walls.

4. The fixture in accordance with claim 1 wherein said arm includes a threaded portion at one end which engages a threaded opening in the flat surface of said one member.

5. The fixture in accordance with claim 4 further comprising a gap gasket disposed about said threaded opening whereby said arm may be sealed regardless of the rotational position of said one member.

6. The fixture in accordance with claim 1 wherein said arm is hollow and defines a wire path extending between said base member and said housing member.

7. The fixture in accordance with claim 3 wherein at least portions of the indented side adjacent to said walls and the portion of the arm mounted to the other of said members are serrated whereby said arm portion may be locked into position against said member.

* * * * *